US005345215A

United States Patent [19]

Okumura et al.

[11] Patent Number: 5,345,215

[45] Date of Patent: Sep. 6, 1994

[54] VARIABLE RESISTOR DEVICE WITH REDUCED SLIDER VIBRATION

[75] Inventors: Hirofumi Okumura; Kanji Ishibara, both of Miyagi, Japan

[73] Assignee: Alps Electric Co., Ltd., Tokyo, Japan

[21] Appl. No.: 8,961

[22] Filed: Jan. 26, 1993

[30] Foreign Application Priority Data

Feb. 3, 1992 [JP] Japan ..... 4-17772

[51] Int. Cl.[5] ..... H01C 10/38

[52] U.S. Cl. ..... 338/176; 338/183; 338/202

[58] Field of Search ..... 338/176, 177, 178, 179, 338/180, 181, 182, 183, 202, 184

[56] References Cited

U.S. PATENT DOCUMENTS

| | | | |
|---|---|---|---|
| 1,908,503 | 5/1933 | Behrend et al. | 338/176 |
| 2,900,615 | 8/1959 | Gottschall et al. | 338/176 |
| 2,909,750 | 10/1959 | Pitzer | 338/176 |
| 3,609,623 | 9/1971 | Zdanys, Jr. | 338/184 |
| 4,053,865 | 10/1977 | Brown, Jr. | 338/180 |
| 4,284,969 | 8/1981 | Carbonneau . | |
| 4,479,107 | 10/1984 | Bleeke | 338/176 |
| 4,575,929 | 3/1986 | Bleeke . | |
| 4,583,032 | 4/1986 | Nunziata et al. | 338/176 X |
| 4,665,376 | 5/1987 | Heinrich | 338/176 |
| 4,862,982 | 9/1989 | Saito et al. . | |
| 5,095,299 | 3/1992 | Wakamatsu | 338/182 |

*Primary Examiner*—Marvin M. Lateef

*Attorney, Agent, or Firm*—Guy W. Shoup; Patrick T. Bever

[57] ABSTRACT

A variable resistor device including a casing and a shaft slidably connected to the casing along its axis. The casing houses a resistive substrate and a slider which is movable along a surface of the resistive substrate. The casing also defines a pair of guide grooves for receiving protrusions extending from the slider, thereby restraining the slider to slide along a path defined by the guide grooves. One side of the slider contacts an end of the shaft, and an opposite side of the slider is pressed by a spring. The spring force is parallel to but spaced away from the axis of the shaft; therefore, the forces acting on the slider create a torque. Because the slider is not connected to the shaft, the slider pivots within a small clearance provided by the guide groove in response to the torque, thereby causing the projections of the slider to press against the walls of the guide groove and thereby preventing vibration of the slider relative to the casing.

6 Claims, 6 Drawing Sheets

VARIABLE RESISTOR DEVICE WITH REDUCED SLIDER VIBRATION

BACKGROUND OF THE INVENTION

1. Field of the Invention

The present invention relates to sliding type electronic parts, provided in a vehicle having a gasoline engine installed therein, for use as a sensor for controlling the ratio at which gasoline is mixed with air or as a stroke sensor for controlling the amount of exhaust gas to be recycled.

2. Description of the Related Art

The applicant of the present invention proposes a sensor, including a variable resistor, for controlling the ratio at which gasoline is mixed with air or controlling the amount of exhaust gas to be recycled, as disclosed in, for example, Japanese Utility Model Laid-Open No. 3-104701.

FIG. 12 is a sectional view illustrating a conventional sensor of the above type. This sensor comprises a casing 1 which forms an outer shell; a shaft 2 movable from side to side in FIG. 12 with respect to the casing 1; a pair of projections 3 provided on the shaft 2; a resistance substrate 4 provided within the casing 1; a brush 5 which slidably contacts a conductive pattern (not shown), such as a resistor or current collector, provided on the resistance substrate 4; a slider receiver 6 for holding the brush 5; a return spring 7 for supplying a spring force to the slider receiver 6; and an external terminal 8 connected to the resistance substrate 4. A pair of guide grooves (not shown), extending parallel to the shaft line of the shaft 2, with which grooves the corresponding projections 3 are engaged, are provided in the casing 1. In this sensor, the slider receiver 6 is slid parallel to the shaft line of the shaft 2 in opposition to the return spring 7 due to the pressing force of the shaft 2. The projections 3 and the guide grooves constitute a guide portion for guiding the slider receiver 6 in a direction parallel to the shaft line of the shaft 2.

However, the above-described conventional sensor has a problem as described below. Since a gap of a predetermined dimension is formed between the projections 3 and the guide grooves, the slider receiver 6 vibrates relative to the guide groove due to the vibration of the vehicle, causing the brush 5 to slide very slightly on the resistance substrate 4. As a result, the current-conductive pattern, the brush 5, the projections 3 and the guide grooves wear quite significantly.

SUMMARY OF THE INVENTION

The present invention has been achieved in view of the above-described circumstances of the prior art.

An object of the present invention is to provide a sensor capable of preventing vibrations of a slider receiver relative to a casing housing a receiver.

To achieve the above object, the present invention comprises: a casing which forms an outer shell; a shaft movable along the shaft line; a guide portion provided parallelly to the shaft line of the shaft; a substrate provided within the casing; a brush which slidably contacts a conductive pattern provided on the substrate; a slider receiver for holding the brush, which receiver is guided by the guide portion; a return spring for supplying a spring force to the slider receiver, wherein the slider receiver is slid parallel to the shaft line of the shaft in opposition to the return spring due to the pressing force of the shaft, one of the ends of the slider receiver being pressed against the guide portion by positioning the return spring offset from the shaft line of the shaft.

In the present invention, since the return spring is positioned away from the axis (shaft line) of the shaft as described above, one of the ends of the slider receiver is pressed against the guide portion. Therefore, a resilient force acts due to the return spring, regulating the movement of the slider receiver in a direction parallel to the shaft line of the shaft. When a regulating surface is provided on the portion where one of the ends of the slider receiver is pressed against the guide portion, the movement of the slider receiver is also regulated perpendicularly to the flat surface including the shaft line of the shaft and the center line of the return spring. Thus, relative vibrations of a slider receiver can be prevented.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DESCRIPTION OF THE PREFERRED EMBODIMENTS

Embodiments of the present invention will be explained below with reference to FIGS. 1 to 8.

Figure 1:
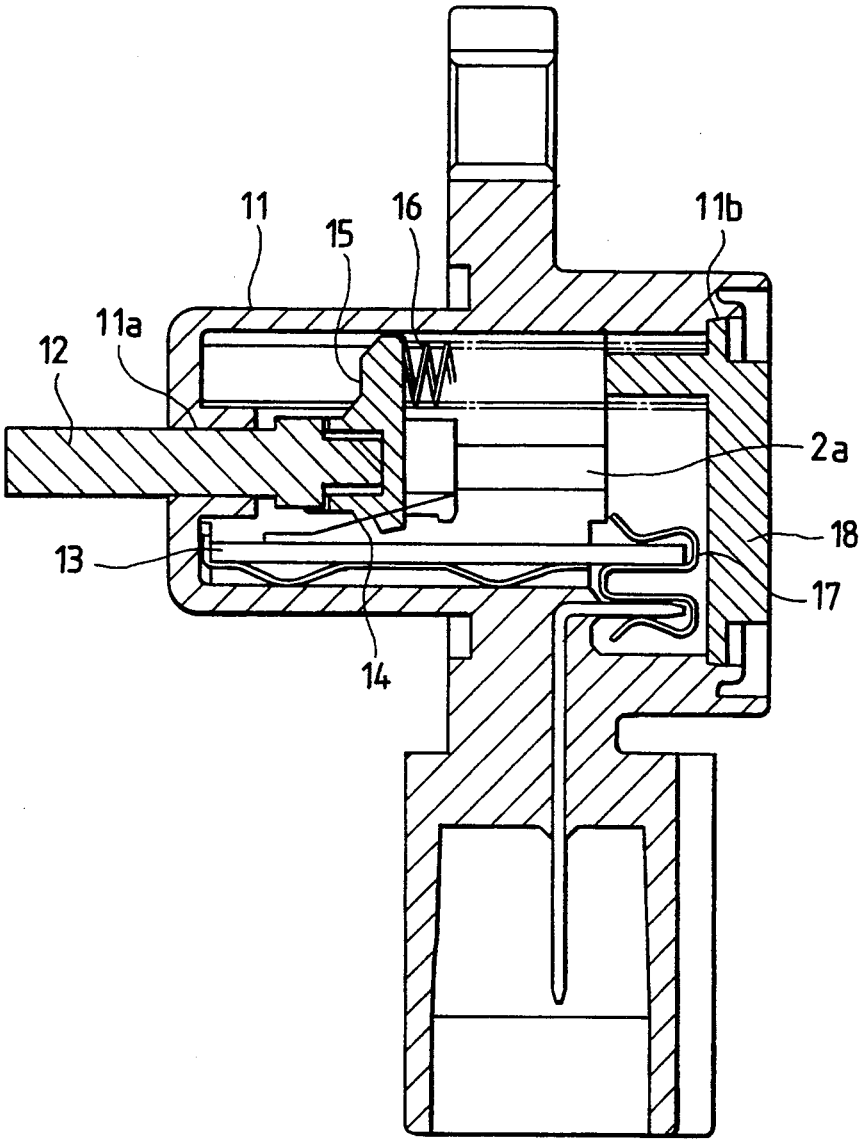
FIG. 1 is a sectional view illustrating a first embodiment of a sensor of the present invention.

The sensor of the first embodiment shown in FIG. 1 comprises a casing 11 which forms an outer shell; a shaft 12 having an axis (shaft line) and being movable along its axis with respect to the casing 11; a resistance substrate 13 provided within the casing 11; a brush (slider) 14 which slidably contacts a conductive pattern (not shown), such as a resistor or current collector, provided on the resistance substrate 13; a slider receiver 15 for holding the brush 14; a return spring 16 for supplying a spring force to the slider receiver 15, which spring is positioned offset from the shaft line of the shaft 12; and an external terminal 17 connected to the resistance substrate 13.

Figure 2:
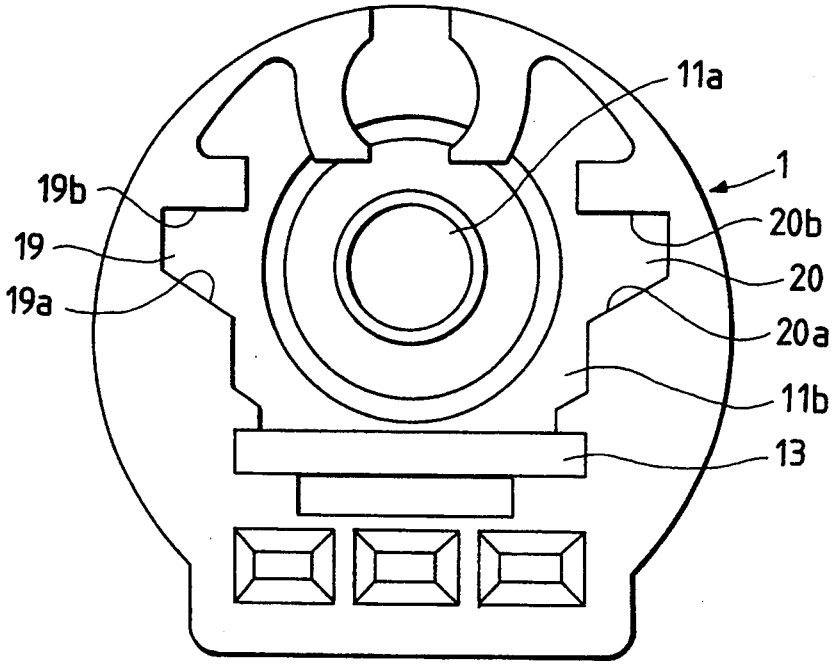
FIG. 2 is an illustration of a casing provided in the sensor as seen from an opening portion of the sensor.
Figure 3:
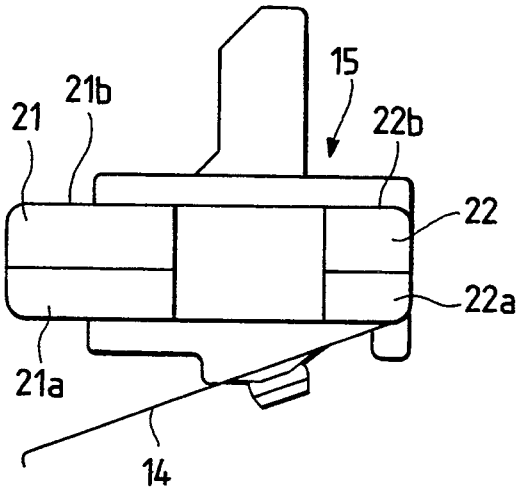
FIG. 3 is a side view illustrating a state in which a brush is mounted on a slider receiver.
Figure 4:
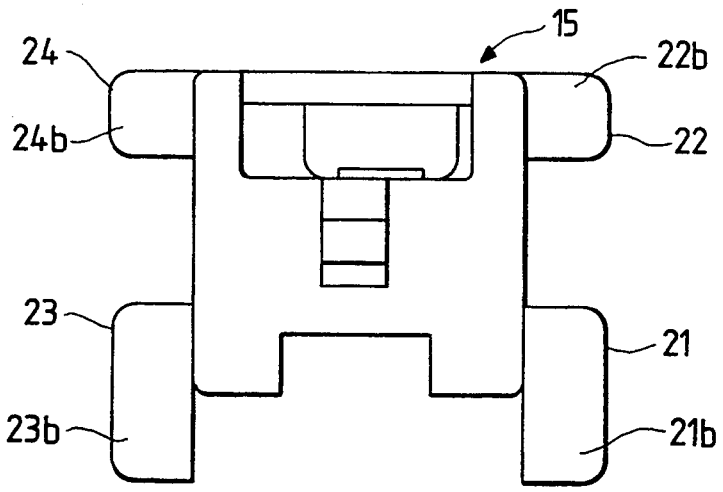
FIG. 4 is a plan view of the slider receiver shown in FIG. 3.

In the casing 11, the shaft 12 is inserted into a slot 11*a* provided in one of the ends of the casing 11, and a cover 18 is mounted on an opening 11*b* provided in the other end. As shown in FIG. 2, the casing 11 has provided therein a pair of guide grooves 19 and 20 extending parallelly to the shaft line of the shaft 12. As shown in FIG. 4, the slider receiver 15 has first and second projections 21 and 22 which engage one of the pair of the guide grooves 19, and first and second projections 23 and 24 which engage the other of the pair of the guide grooves 20. The first projection 21 has a lower tapered surface 21*a* formed to become gradually away from the flat surface including the resistance substrate 13 toward the side end and an upper flat surface 21*b* formed parallel to the flat surface including the resistance substrate 13. In a similar manner, the projections 22 to 24 have tapered surfaces 22*a* to 24*a* and flat surfaces 22*b* to 24, respectively. The guide groove 19 have an inclined surface 19*a* contacting the tapered surfaces 21*a* and 22*a* and a flat surface 19*b* contacting the flat surfaces 21*b* and 22*b*. In a similar manner, the guide groove 20 has an inclined surface 20*a* and a flat surface 20*b*. As shown in FIG. 3, the brush 14 is formed in the form of a straight line when it does not slidably contact the resistance substrate 13. As shown in FIG. 1, when the brush 14 slidably contacts the resistance substrate 13, it flexes in the form of a circular arc and yieldingly contacts the resistance substrate 13. In this condition, a sliding-contact surface 14*a* of the brush 14 is arranged near an end portion $A_1$ of the tapered surface 21*a* of the projection 21 and an end portion $A_2$ of the tapered surface 23*a* of the projection 23, The guide grooves 19 and 20, and the projections 21 to 24 constitute a guide portion for guiding the slider receiver 15 in a direction parallel to the shaft line of the shaft 12. The tapered surfaces 21*a* to 24*a* constitute a regulating surface for regulating the movement of the slider receiver 15 in a direction at right angles to the flat surface including the shaft line of the shaft 12 and the center line of the return spring 16, i.e., from side to side in FIG. 5.

Figure 5:
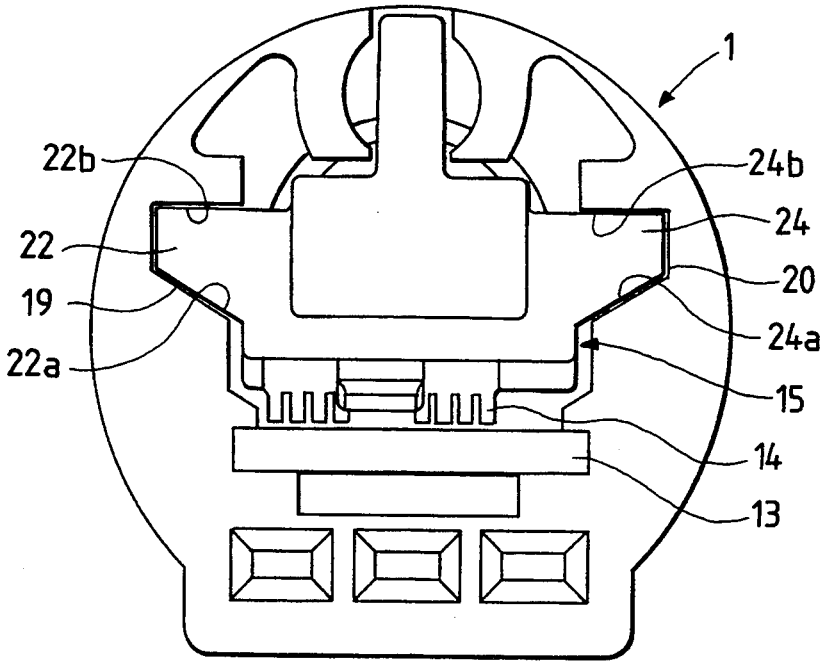
FIG. 5 is a view illustrating a state in which the slider receiver and the brush shown in FIG. 3 are mounted on the casing shown in FIG. 2.
Figure 6:
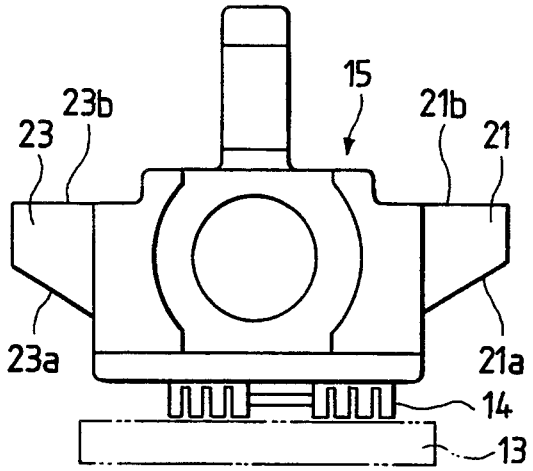
FIG. 6 is a view of the slider receiver and the brush shown in FIG. 5 as seen from an opening portion of the casing.
Figure 7:
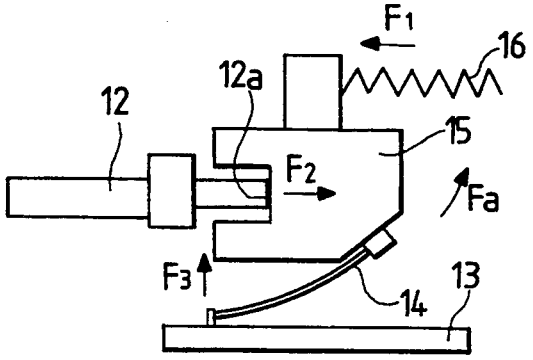
FIG. 7 is an illustration of a force acting on the slider receiver provided in the sensor shown in FIG. 1.
Figure 8:
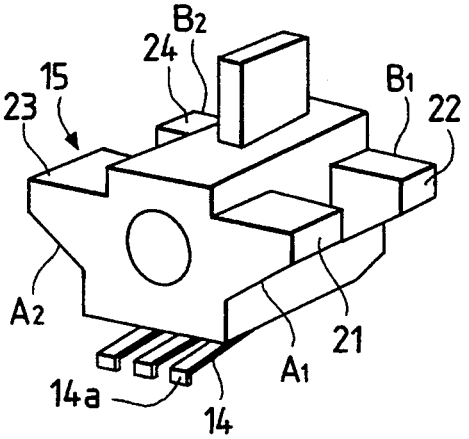
FIG. 8 is an illustration of the slider receiver shown in FIG. 7.

In this first embodiment, since a first force $F_1$ which the return spring 16 presses to the left in FIG. 7, a second force $F_2$ which the shaft 12 presses to the right in FIG. 7, and a third force $F_3$ which the brush 14 presses upward in FIG. 7 act on the slider receiver 15, a rotational force Fa (approximately equal to the first force $F_1$ − the third force $F_3$) is applied to the slider receiver 15. Since the first force $F_1$ is greater than the third force $F_3$, the slider receiver 15 rotates in a counterclockwise direction in FIG. 7 with an end 12*a* of the shaft 12 as a fulcrum. As a result, the end portion $A_1$ of the tapered surface 21*a* of the projection 21 is yieldingly pressed against the inclined surface 19*a* of the guide groove 19, and the end portion $A_2$ of the tapered surface 23*a* of the projection 23 is yieldingly pressed against the inclined surface 20*a* of the guide groove 20. In a similar manner, the end portion $B_1$ of the flat surface 22*b* of the projection 22 is yieldingly pressed against the flat surface 19*b* of the guide groove 19, and the end portion $B_2$ of the flat surface 24*b* of the projection 24 is yieldingly pressed against the flat surface 20*b* of the guide groove 20. In this condition, the upward and downward movement of the slider receiver 15 in FIG. 5 is regulated. Since the end portion $A_1$ of the tapered surface 21*a* and the end portion $A_2$ of the tapered surface 23*a* are yieldingly pressed against the guide grooves 19 and 20, respectively, as described above, the movement of the slider receiver 15 in a direction at right angles to the flat surface including the shaft line of the shaft 12 and the center line of the return spring 16, i.e., from side to side in FIG. 5, is regulated by the projections 21 and 23.

In the first embodiment constructed as described above, since the slider receiver 15 is regulated to move upward and downward or from side to side in FIG. 5, relative movement of the slider receiver 15 can be prevented. At this time, the slider receiver 15 moves slightly from side to side in FIG. 5 on the side of the projections 22 and 24. However, since the sliding-contact surface 14*a* of the brush 14 is arranged near the end portions $A_1$ and $A_2$, the relative movement of the sliding-contact surface 14*a* can be reduced considerably.

Even though the inclined surface 19*b* is provided on the guide groove 19 in this embodiment, a flat surface parallel to the flat surface including the resistance substrate 13 may be provided in place of the inclined surface 19*a*. The same applies for the other guide groove 20. Furthermore, even though the flat tapered surfaces 21*a* to 24*a* are provided on the projections 21 to 24, respectively, these tapered surfaces may be formed as circular-arc surfaces. Even though the guide grooves 19 and 20 are provided on the casing 11 and the projections 21 to 24 are provided in the slider receiver 15 in this embodiment, the same effect can also be obtained if projections are provided on the casing and guide grooves are provided on the slider receiver.

A second embodiment of the present invention will be explained with reference to FIGS. 9 to 11. Components which are the same as in the first embodiment are given the same reference numerals. As was previously described, reference numeral 13 denotes a resistance substrate, and reference numeral 14 denotes a brush.

Figure 9:
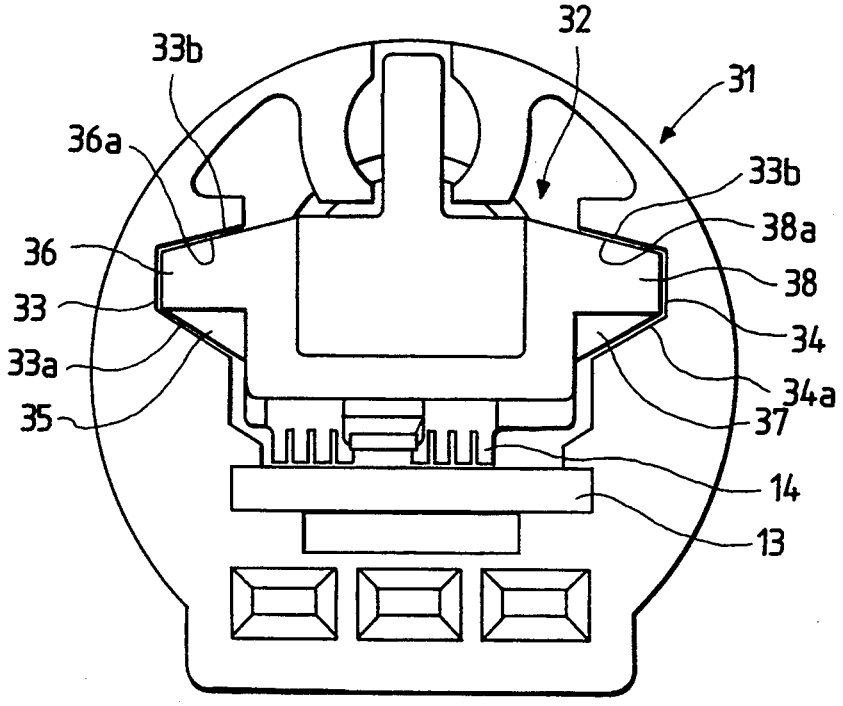
FIG. 9 is a sectional view of a second embodiment of a sensor of the present invention as seen from an opening portion of a casing.
Figure 10:
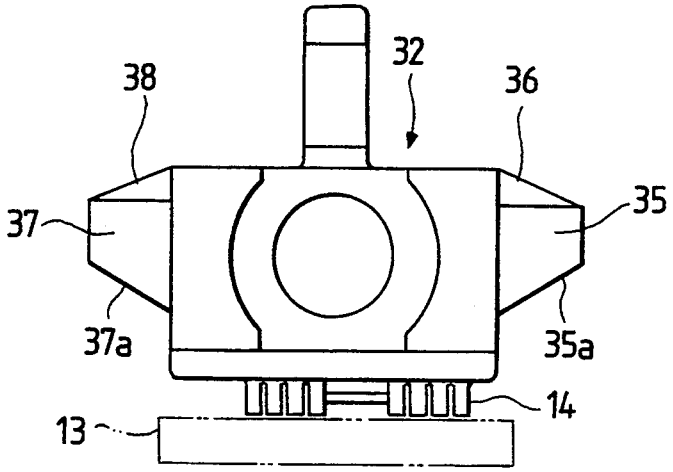
FIG. 10 is an illustration of a slider receiver and a brush as seen from the opening portion of the casing.

As compared to the first embodiment described above, a casing 31 which forms an outer shell and a slider receiver 32 for holding the brush 14 are provided in the sensor of this embodiment shown in FIG. 9. The other components are the same as in the first embodiment.

As shown in FIG. 9, the casing 31 comprises a pair of guide grooves 33 and 34 extending parallel to the shaft line of the shaft 2 in FIG. 1. The slider receiver 32 comprises projections 35 and 36 which engage one of the guide grooves 33 and projections 37 and 38 which engage the other guide groove 34. The projection 35 has a lower tapered surface 35*a* in a lower portion thereof formed to become gradually apart from the flat surface including a resistance substrate 33 toward the side end. In a similar manner, the projection 37 has a tapered surface 37*a* in a lower portion thereof. The projection 36 has a tapered surface 36*a* in an upper portion thereof formed to become gradually apart from the flat surface including the resistance substrate 13 toward the side end. In a similar manner, the projection 38 has a tapered surface 38*a* in an upper portion thereof. The guide groove 33 has an inclined surface 33*a* which contacts the tapered surface 35*a* and an inclined surface 33*b* which contacts the tapered surface 36*a*. The same applies for the other guide groove 34; it has inclined surfaces 34*a* and 34*b*. As shown in FIG. 11, the brush 14 is formed in a straight line when it does not slidably contact the resistance substrate 13. When the brush 14 slidably contact the resistance substrate 13, it flexes in the form of a circular arc and yieldingly contacts the resistance substrate 13. The guide grooves 33 and 34 and the projections 35 to 38 constitute a guide portion for guiding the slider receiver 32 in a direction parallel to the shaft line of the shaft 12. The tapered surfaces 35*a* to 38*a* constitute a regulating surface for regulating the movement of the slider receiver 32 in a direction at right angles to the flat surface including the shaft line of the shaft 12 and the center line of the return spring 16, i.e., from side to side in FIG. 9.

Figure 11:
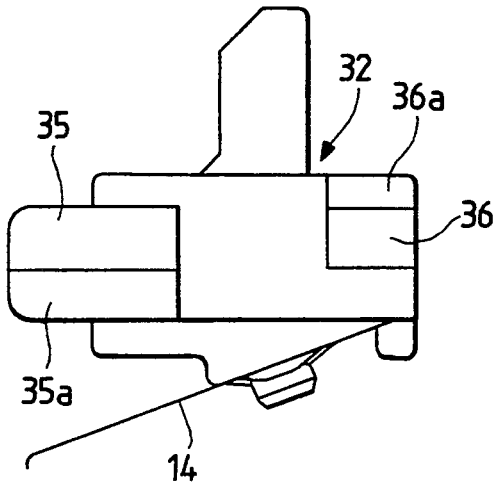
FIG. 11 is a side view illustrating a state in which the brush is mounted on the slider receiver.
Figure 12:
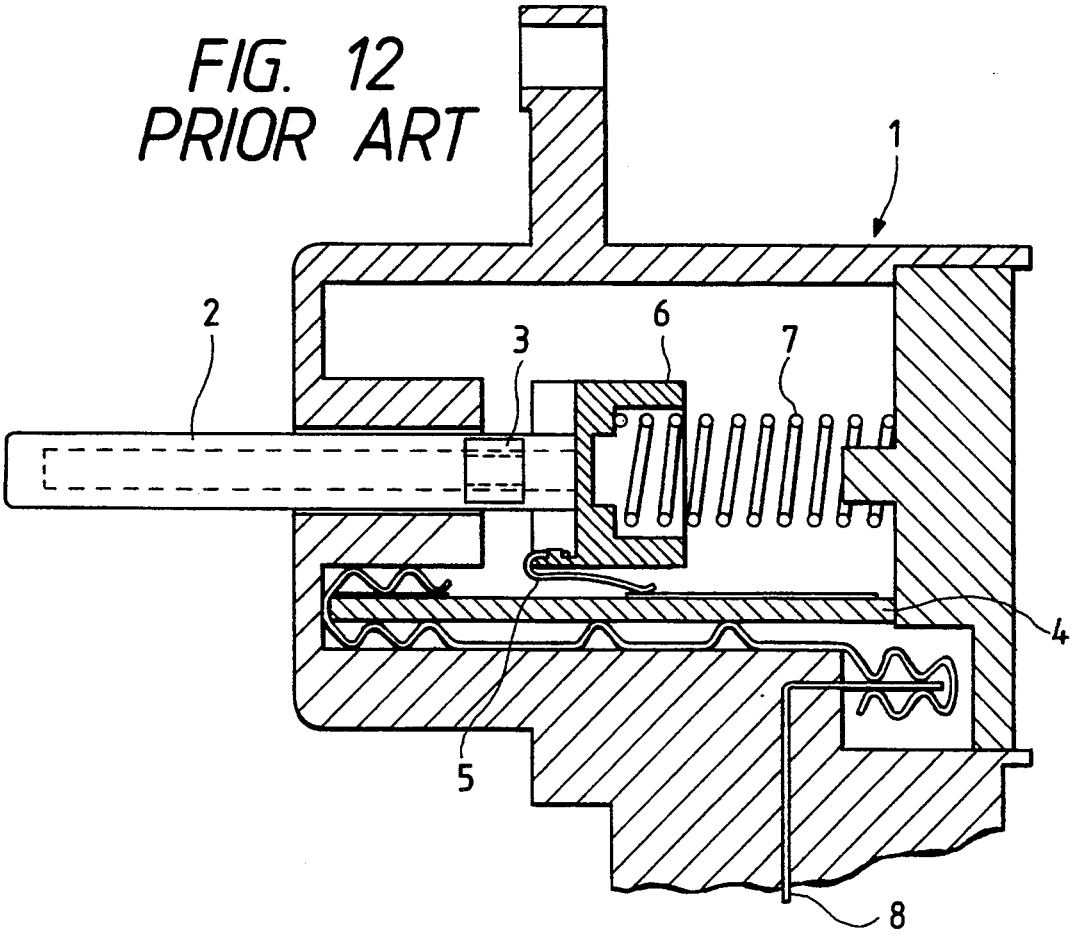
FIG. 12 PRIOR ART
FIG. 12 is a sectional view illustrating a conventional sensor.

In this second embodiment, a rotational force in a counterclockwise direction in FIG. 11 is applied to the slider receiver 32 in the same manner as in the first embodiment. The end portion of the tapered surface 35*a* of the projection 35 is yieldingly pressed against the inclined surface 33*a* of the guide groove 33, and the end portion of the tapered surface 37*a* of the projection 37 is yieldingly pressed against the inclined surface 34*a* of the guide groove 34. At the same time, the end portion of the tapered surface 36*a* of the projection 36 is yieldingly pressed against the inclined surface 33*a* of the guide groove 33, and the end portion of the tapered surface 38*a* of the projection 38 is yieldingly pressed against the inclined surface 34*a* of the guide groove 34. In this condition, the slider receiver 32 is regulated to move upward and downward and also to move from side to side in FIG. 9.

Since the upward and downward and side-to-side movements of the slider receiver 32 are regulated in FIG. 9 in the second embodiment constructed as described above, a relative movement of the slider receiver 32 can be prevented. Even though the inclined surfaces 33*a* and 33*b* are provided in the guide groove 33 in this embodiment, a flat surface formed parallel to the flat surface including the resistance substrate 13 may be provided in place of the inclined surfaces 33*a* and 33*b*. The same applies for the other guide groove 34. Even though the tapered surfaces 35*a* to 38*a* are formed to be flat in this embodiment, they may be formed as a circular arc instead. Even though the guide grooves 33 and 34 are provided in the casing 31 and the projections 35 to 38 are provided in the slider receiver 32 in this embodiment, the present invention is not limited to this construction. The same effect can also be obtained if projections are provided in a casing and guide grooves are provided in a slider receiver.

Since the present invention is constructed as described above, relative vibrations of a slider receiver can be prevented. As a result, wearing of substrates, brushes, projections and guide grooves can be reduced, increasing the durability of the sensor.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included with the spirit and scope of the claims. The following claims are to be accorded the broadest interpretation, so as to encompass all such modifications and equivalent structures and functions.

What is claimed is:

1. A variable resistor device comprising:

a casing defining an elongated guide groove having a wall;

a shaft defining an axis, the shaft being housed in the casing such that the shaft is movable in a direction defined by the axis;

a substrate fixedly provided within the casing;

a slider contained in the housing and having a projection slidably received in the guide groove, the slider abutting an end of the shaft such that the slider is pivotable relative to the shaft;

a brush fixedly connected to the slider which slidably contacts the substrate; and a return spring disposed in the casing, the return spring connected to the slider such that a spring force exerted by the return spring on the slider biases the slider against the shaft, wherein the guide groove is parallel to and located away from the axis of the shaft such that the slider is pivoted by the spring force about the end of the shaft, thereby pressing the projection against the wall of the guide groove.

2. A variable resistor device according to claim 1, wherein the guide groove includes first and second elongated walls extending parallel to the axis of the shaft, wherein the first elongated wall is formed at an angle with respect to the second elongated wall.

3. A variable resistor device according to claim 2, wherein the projection of the slider is shaped to slidably fit within the first and second walls of the guide groove.

4. A variable resistor device according to claim 3, wherein the casing defines a second guide groove parallel to the axis;

wherein the second guide groove includes third and fourth elongated walls extending parallel to the axis of the shaft such that the third elongated wall is formed at an angle with respect to the fourth elongated wall, and wherein the slider includes a second projection slidably received in the second guide groove.

5. A variable resistor device comprising:

a casing defining a guide groove having a wall;

a shaft slidably connected in the casing, the shaft defining an axis;

a slider housed in the casing, the slider having a projection slidably received in the guide groove, the slider abutting an end of the shaft such that movement of the shaft along its axis toward the slider causes sliding of the slider along a path defined by the guide groove; and a resilient member disposed in the casing and connected to the slider such that the resilient member biases the slider against the shaft;

wherein forces exerted on the slider by the shaft and the resilient member create a torsion force which presses the projection of the slider against the wall of the guide groove, thereby preventing the slider from vibrating relative to the housing.

6. A variable resistor device according to claim 5, wherein the slider further comprises a brush located adjacent the end of the slider abutting the shaft;

wherein the guide groove comprises first and second elongated walls extending parallel to the axis of the shaft such that the first elongated wall is formed at a predetermined angle with respect to the second elongated wall;

wherein the projection includes a first portion located adjacent the end of the slider abutting the shaft and a second portion located adjacent a second end of the slider, each of the first and second portions including third and fourth walls, the third elongated walls being formed at the predetermined angle with respect to the fourth elongated walls; and wherein the projection of the slider is formed such that rotation of the slider presses the first portion of the projection against the first wall and the second portion of the projection against the second wall.

* * * * *